US011852137B2

(12) United States Patent
Cuneo et al.

(10) Patent No.: US 11,852,137 B2
(45) Date of Patent: Dec. 26, 2023

(54) AUTOMOTIVE VARIABLE MECHANICAL LUBRICANT PUMP

(71) Applicant: PIERBURG PUMP TECHNOLOGY GMBH, Neuss (DE)

(72) Inventors: Carmine Cuneo, Pisa (IT); Massimiliano Lazzerini, CECINA (IT)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 663 days.

(21) Appl. No.: 16/977,816

(22) PCT Filed: Mar. 5, 2018

(86) PCT No.: PCT/EP2018/055347
§ 371 (c)(1),
(2) Date: Sep. 3, 2020

(87) PCT Pub. No.: WO2019/170216
PCT Pub. Date: Sep. 12, 2019

(65) Prior Publication Data

US 2020/0400142 A1 Dec. 24, 2020

(51) Int. Cl.

| | |
|---|---|
| ***F04C 14/22*** | (2006.01) |
| ***F01C 21/10*** | (2006.01) |
| ***F01M 1/16*** | (2006.01) |
| ***F04C 2/344*** | (2006.01) |
| *F01M 1/02* | (2006.01) |

(52) U.S. Cl.
CPC ..... *F04C 14/226* (2013.01); *F04C 2/3442* (2013.01); *F01M 1/16* (2013.01);
(Continued)

(58) Field of Classification Search
CPC .. F04C 14/226; F04C 2/3442; F04C 2210/14; F04C 2210/206; F04C 2240/20;
(Continued)

(56) References Cited

U.S. PATENT DOCUMENTS

2010/0028171 A1 2/2010 Shulver et al.
2014/0219847 A1* 8/2014 Watanabe ..... F04C 2/3442 418/24

(Continued)

FOREIGN PATENT DOCUMENTS

CN 202732023 U 2/2013
CN 102705034 B 9/2014

(Continued)

*Primary Examiner* — Jacob M Amick
(74) *Attorney, Agent, or Firm* — Norman B. Thot

(57) ABSTRACT

A variable mechanical lubricant pump provides a pressurized lubricant for an internal combustion engine. The lubricant pump includes a delivery port which is fluidically connected to the engine, a control ring which shifts between a maximum and a minimum eccentricity position, a pump rotor having slidable vanes which rotate in the control ring, a control ring preload spring which pushes the control ring into the maximum eccentricity position, a hydraulic control chamber which pushes the control ring into the minimum eccentricity position, a pressure galley pump port fluidically connected to the engine, and an overpressure valve fluidically associated with the delivery port. The pressure gallery pump port charges the hydraulic control chamber with a gallery pressure to control a remote gallery pressure of the engine via a control chamber pressure in the hydraulic control chamber. The overpressure valve opens if an applied lubricant pressure exceeds a predefined maximum pressure limit.

14 Claims, 4 Drawing Sheets

(52) U.S. Cl.
CPC ..... *F01M 2001/0238* (2013.01); *F01M 2001/0246* (2013.01); *F04C 2210/14* (2013.01); *F04C 2210/206* (2013.01); *F04C 2240/20* (2013.01); *F04C 2240/809* (2013.01); *F04C 2270/18* (2013.01); *F04C 2270/48* (2013.01)

(58) Field of Classification Search
CPC ..... F04C 2240/809; F04C 2270/18; F04C 2270/48; F01M 1/16; F01M 2001/0238; F01M 2001/0246
See application file for complete search history.

(56) References Cited

U.S. PATENT DOCUMENTS

| | | | |
|---|---|---|---|
| 2016/0115832 | A1 | 4/2016 | Celata et al. |
| 2016/0222843 | A1 | 8/2016 | Koguchi et al. |
| 2016/0290335 | A1 | 10/2016 | Cuneo et al. |
| 2018/0023564 | A1 | 1/2018 | Naganuma |
| 2019/0345852 | A1 | 11/2019 | Kato et al. |

FOREIGN PATENT DOCUMENTS

| | | | |
|---|---|---|---|
| CN | 104612967 | B | 5/2015 |
| CN | 204328433 | U | 5/2015 |
| CN | 105264230 | A | 1/2016 |
| CN | 103821580 | B | 2/2017 |
| JP | 2016-44624 | A | 4/2016 |
| JP | 2016-48034 | A | 4/2016 |
| KR | 10-1505775 | B1 | 3/2015 |
| WO | WO 2008/037070 | A1 | 4/2008 |
| WO | WO 2012/149929 | A2 | 11/2012 |
| WO | WO 2013/038221 | A1 | 3/2013 |
| WO | WO 2015/160178 | A1 | 10/2015 |
| WO | WO 2016/125639 | A1 | 8/2016 |
| WO | WO 2018/123682 | A1 | 7/2018 |

* cited by examiner

AUTOMOTIVE VARIABLE MECHANICAL LUBRICANT PUMP

CROSS REFERENCE TO PRIOR APPLICATIONS

This application is a U.S. National Phase application under 35 U.S.C. § 371 of International Application No. PCT/EP2018/055347, filed on Mar. 5, 2018. The International Application was published in English on Sep. 12, 2019 as WO 2019/170216 A1 under PCT Article 21(2).

FIELD

The present invention relates to an automotive variable mechanical lubricant pump for providing pressurized lubricant for an internal combustion engine.

BACKGROUND

An automotive variable mechanical lubricant pump is mechanically driven by the internal combustion engine. The mechanical lubricant pump is designed as a positive displacement pump and is provided with a pump rotor with numerous slidable rotor vanes which rotate within a shiftable control ring which is slidable between a maximum eccentricity position and a minimum eccentricity position. The rotor vanes separate the pumping chamber into numerous rotating pumping compartments. The compartment stroke is varied by increasing or decreasing the eccentricity of the control ring with respect to the pump rotor. Since the compartment stroke is variable, the pump delivery pressure can be controlled and kept more or less constant independent of the rotational speed of the lubricant pump.

In a relatively simple and cost-effective construction, the mechanical lubricant pump is provided with one control ring preload spring for pushing the control ring into the maximum eccentricity position in which the compartment stroke is maximized and is provided with one single counter-acting hydraulic control chamber for pushing the control ring into the minimum eccentricity position. The control chamber is typically directly charged with the pump outlet pressure. The hydraulic pressure in the control chamber can be controlled by a separate hydraulic control valve which regulates the hydraulic control chamber pressure.

WO 2008 037 070 A1 describes a typical variable mechanical lubricant pump with a hydraulic closed-loop control circuit for controlling the lubricant delivery pressure of the pump. The control circuit is provided with a complex control valve with five hydraulic ports and with two active plunger surfaces. A first active plunger surface is always pressurized with the pump delivery pressure, and the second active plunger surface can selectively be pressurized with the delivery pressure or with atmospheric pressure so that a second level of a set delivery pressure can be selected.

It can in practice be disadvantageous to control the pump's delivery pressure as the control variable because the fluidic resistance of the engine is highly variable. A reliable lubrication of the engine can only be guaranteed with a relatively high set delivery pressure considering the highest possible fluidic resistance of the engine.

The control variable can alternatively be the gallery pressure of the engine. It is generally not a significant problem that the actual lubricant pressure value is picked up remote from the pump delivery port. However, when the engine is started after having stood still, the engines and the pump's hydraulic system is empty and is only successively filled with the pressurized lubricant. The detected gallery pressure is therefore very low at the beginning of the starting procedure so that the control ring stays in the maximum eccentricity position until the lubricant has arrived at the engine's gallery and until the separate hydraulic control valve is charged with the lubricant gallery pressure. The mechanical lubricant pump consequently runs with a maximum eccentricity as long as the lubricant has not arrived at the pickup location of the gallery pressure.

SUMMARY

An aspect of the present invention is to provide a simple and reliable automotive variable mechanical lubricant pump.

In an embodiment, the present invention provides an automotive variable mechanical lubricant pump which provides a pressurized lubricant for an internal combustion engine. The automotive variable mechanical lubricant pump includes a lubricant delivery port which is fluidically connected to the internal combustion engine, a control ring which is configured to shift between a maximum eccentricity position and a minimum eccentricity position, a pump rotor comprising a plurality of slidable vanes which are configured to rotate in the control ring, a control ring preload spring which is configured to push the control ring into the maximum eccentricity position, a single hydraulic control chamber which is configured to push the control ring into the minimum eccentricity position, a pressure galley pump port which is fluidically connected to the internal combustion engine, and an integrated overpressure valve which is in a fluidic association with the lubricant delivery port. The pressure gallery pump port is configured to charge the single hydraulic control chamber with a gallery pressure so as to control a remote gallery pressure of the internal combustion engine via a control chamber pressure in the single hydraulic control chamber. The integrated overpressure valve is configured to open if an applied lubricant pressure exceeds a predefined maximum pressure limit.

BRIEF DESCRIPTION OF THE DRAWINGS

The present invention is described in greater detail below on the basis of embodiments and of the drawings in which.

DETAILED DESCRIPTION

Figure 1:
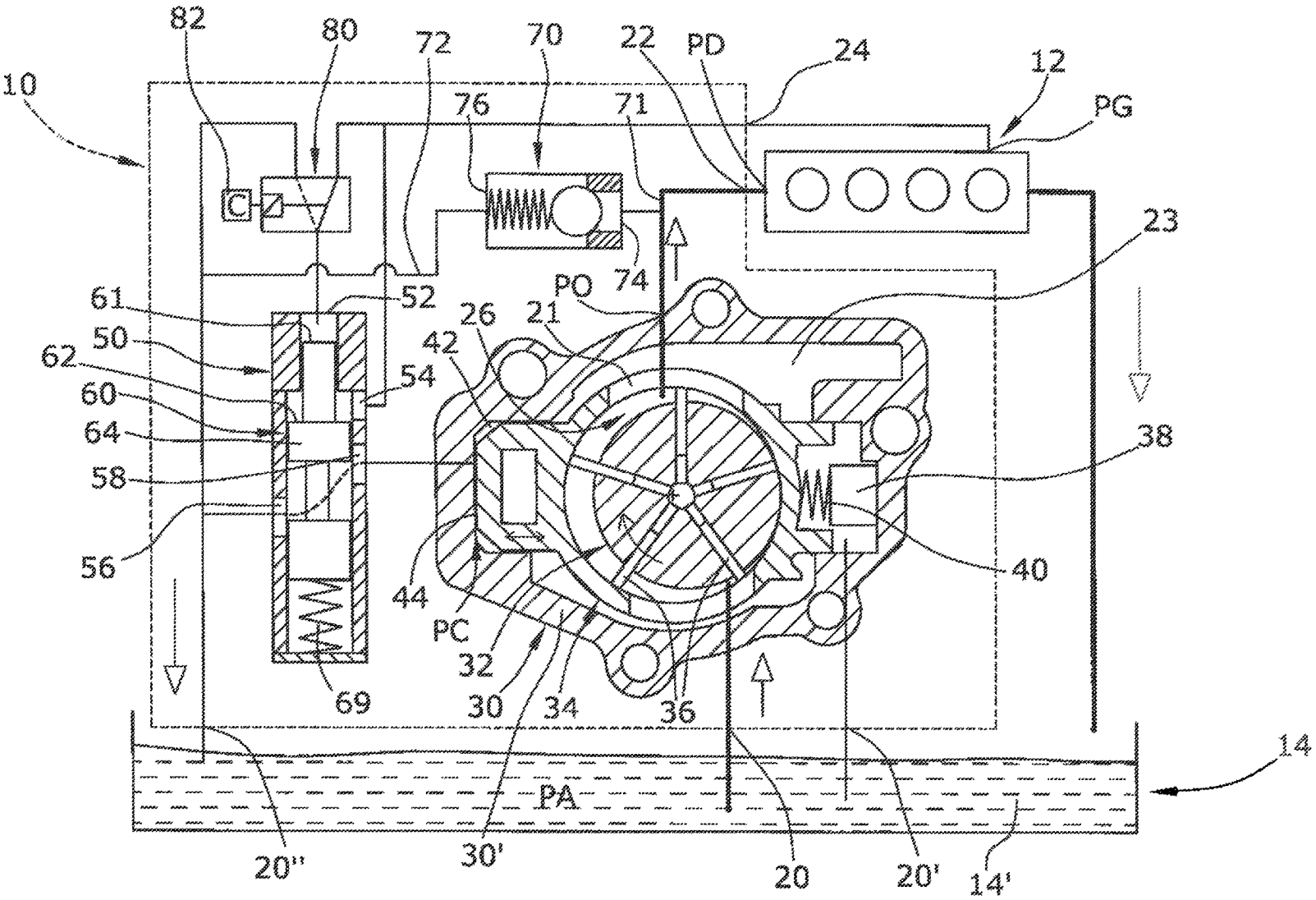
FIG. 1 schematically shows a closed-loop control circuit with an internal combustion engine which is supplied with pressurized lubricant coming from a first embodiment of an automotive variable mechanical lubricant pump with a hydraulic pump control chamber being charged with the pump delivery pressure, with a two-level multi set pressure switch in a low set-pressure condition, and with the pressure control valve in a closed status.

The lubricant pump is provided with a pump rotor having numerous slidable rotor vanes which rotate in a shiftable control ring which is shiftable between a maximum eccentricity position and a minimum eccentricity position. The control ring encloses a pumping chamber where the pumping action takes place. The pumping chamber is divided by the slidable rotor vanes into numerous rotating pumping compartments.

The control ring can be provided to be linearly shiftable or, alternatively, pivotable. The term "eccentricity" refers to the distance between the rotation axis of the pump rotor and the center of the control ring. The inner circumference of the control ring can be precisely circular or can have a non-circular contour. The center of the control ring can, for example, be the geometric middle. The compartment stroke is low at low control ring eccentricity. The compartment stroke is high at high control ring eccentricity.

The lubricant pump is provided with a control ring preload spring for pushing the control ring into the maximum eccentricity direction, and with a single hydraulic control chamber which pushes the control ring into the minimum eccentricity direction against the force of the preload spring. The hydraulic control chamber is charged with the engine's gallery pressure so that the control variable is the engines gallery pressure. No other hydraulic chamber is provided for systematically pushing the control ring into the low or high eccentricity direction. This hydraulic concept of the lubricant pump is simple and cost effective.

The lubricant pump is provided with a closed-loop pressure control circuit for controlling the remote gallery pressure of the engine via the control chamber pressure in the control chamber. In a simplest embodiment, no further control for affecting the general control behavior is provided in the pressure control circuit.

The lubricant pump is provided with an integrated overpressure valve in the fluidic association with the lubricant delivery port of the pump. The overpressure valve can, for example, open to atmospheric pressure if the applied lubricant pressure exceeds a maximum pressure limit. The term "atmospheric pressure" in this context means a pressure in the range of atmospheric pressure. The overpressure valve can, for example, be fluidically connected to the pump inlet which could have a pressure level below the atmospheric pressure. The overpressure valve outlet is, however, always fluidically connected to a pressure level being in the order of atmospheric pressure.

Immediately following a cold start of the engine, the hydraulic pressure control circuit is not or not completely filled with lubricant. Since the control variable is the gallery pressure, the hydraulic control circuit is relatively large and has a relatively high hydraulic volume as it also includes the lubrication channels of the engine. It can therefore take many seconds until the hydraulic control circuit is completely filled with the lubricant.

As long as the hydraulic pressure control circuit is not completely filled and is not working properly, the control ring remains in the maximum eccentricity position so that the pump is running with the maximum volumetric performance. In particular if the lubricant is cold and/or the rotational speed of the engine and of the pump rotor is relatively high, a hydraulic overpressure can occur in the pumping compartments which could damage or destroy the rotor vanes and other engine components as a lubricant filter or lubricant cooler.

The integrated overpressure valve provides that no damaging overpressures can appear downstream of the lubricant delivery port of the pump so that a damaging lubricant overpressure in the pumping compartments is also reliably avoided.

The term "integrated" means that the overpressure valve is a part of the mechanical lubricant pump, and is, for example, integrated in the housing body of the pump. Since the overpressure valve is integrated into the pump, no external overpressure valve is needed.

The lubricant pump according to the present invention is hydraulically a simple construction, provides a reliable lubrication of the engine because the control variable is the engine's gallery pressure, and reliably avoids damaging lubricant overpressures with a simple integrated overpressure valve in fluidic association with the lubricant delivery port.

In an embodiment of the present invention, the overpressure valve can, for example, be fluidically arranged upstream of a pumping chamber outlet of the pumping chamber and downstream of the lubricant delivery port of the pump. The overpressure valve can, for example, be arranged fluidically as close as possible to the pumping chamber outlet so that damage to the slidable vanes can be reliably avoided.

In an embodiment of the present invention, the overpressure valve can, for example, be a typical check valve. A check valve is a simple and reliable mechanical overpressure valve and comprises a valve body and a mechanical spring preloading the valve body into the closed position.

In an embodiment of the present invention, the valve outlet of the overpressure valve can, for example, be fluidically directly connected to an atmospheric pump drain port. The lubricant pump is provided with one or more atmospheric pump drain port which is connectable to the lubricant tank the engine. The lubricant in the engine's lubricant tank is normally more or less at atmospheric pressure.

In an embodiment of the present invention, the hydraulic control circuit can, for example, be provided with a separate hydraulic pressure control valve which directly regulates the control chamber pressure. The valve inlet port of the control valve is directly charged with the remote gallery pressure of the engine via a gallery pressure port of the pump. The hydraulic pressure control valve is basically a pure hydraulic valve without any electric valve for the basic valve function. The hydraulic control valve is therefore a relatively simple and reliable mechanical means for providing and defining properly adapted control characteristics. The hydraulic pressure control valve directs the lubricant's gallery pressure to the control chamber as long as the lubricant pressure charged at the inlet port of the control valve is relatively low. If the lubricant pressure at the inlet port, which is the gallery pressure, is relatively high, the control valve reduces or closes the fluidic connection between the gallery pressure port and the control chamber to thereby control the position of the shiftable control ring to adapt the volumetric pump performance accordingly.

When the engine is started, the hydraulic control circuit including the hydraulic pressure control valve can be in part or completely empty and is only filled with air at atmospheric pressure so that no relevant pressure is present in the hydraulic control chamber. The control ring is in the maximum eccentricity position with the result that the pump performance is at the maximum level. The integrated overpressure valve reliably avoids any overpressure in the pressure part of the lubricant pump.

In an embodiment of the present invention, the hydraulic pressure control valve can, for example, be provided with a plunger comprising a valve body for opening and closing a valve port. If the valve port is open, the control chamber is pressurized with the gallery pressure, if the valve port is closed, the control chamber is not pressurized with the gallery pressure. The hydraulic pressure control valve is provided with a valve preload spring which pushes the valve body into the open valve position in which the valve port is open. The plunger is provided with a first active plunger surface which is charged with the gallery pressure of the gallery pressure port of the control valve.

In an embodiment of the present invention, the control valve plunger can, for example, comprise a second active plunger surface which is charged with the gallery pressure of the gallery pressure port via an electrically activated hydraulic set pressure switch. The second active plunger surface is connected to atmospheric pressure or to the gallery pressure dependent on the switching status of the electrically actuated hydraulic set pressure switch. Two different set-pressures can therefore be chosen. The electrically actuated set pressure switch is controlled by an electronic set pressure control which can be a part of an engine control. The electronic set pressure control selects the set pressure based on numerous conditions, for example, the lubricant temperature, the atmospheric air temperature, engine's rotational speed, etc.

In an embodiment of the present invention, the hydraulic control circuit can, for example, be provided with an electrically controlled and actuated pressure control valve which selectively connects the control chamber to an atmospheric pump drain port or to the gallery pressure port. The electrically controlled pressure control valve can, for example, be a proportional valve which allows the adaption of the lubricant flow to/from the control chamber depending on the engine's pressure situation.

Two embodiments of the present invention are described below with reference to the enclosed drawings.

The drawings show an arrangement of an automotive variable mechanical lubricant pump 10, an internal combustion engine 12, and a lubricant tank 14 with a liquid lubricant 14', namely engine oil. The liquid lubricant 14' in the lubricant tank 14 is sucked by the lubricant pump 10 and is delivered as pressurized lubricant to the engine 12 for lubrication and cooling of the engine 12. The shown and described arrangement defines a closed-loop lubricant pressure control circuit.

The lubricant pump 10 of the first embodiment comprises a pumping unit 30, a hydraulic control valve 50, and an electrically actuated hydraulic set pressure switch 80 which are together all integrated in one single lubricant pump device. The pumping unit 30 is provided with a rotatable pump rotor 32 with five radially slidable rotor vanes 36 which rotate in a linearly shiftable control ring 34. The pump rotor 32 is directly mechanically driven by the engine 12 via a belt or a gear. The control ring 34 is linearly shiftable in a linear shifting direction. The control ring 34 encloses a pumping chamber 26 which is divided by the slidable rotor vanes 36 into five rotating pumping compartments. The pump rotor 32 rotates clockwise.

The control ring 34 is shiftable between a maximum eccentricity position which is shown in all the drawings, thereby providing a maximum compartment stroke, and a minimum eccentricity position providing a minimum compartment stroke. The pumping performance is maximized in the maximum eccentricity position of the control ring 34, whereas the pumping performance is minimized in the minimum eccentricity position of the control ring 34. The control ring 34 is arranged to be shiftable within a pumping unit housing 30' which supports the control ring 34 linearly shiftable. The control ring 34 is pushed by a control ring preload spring 40 into the maximum eccentricity position, as shown in the drawings. The control ring preload spring 40 is provided in a spring chamber 38 which is hydraulically connected to the lubricant tank 14 via a pump drain port 20' and which is generally under atmospheric pressure.

A hydraulic control chamber 42 is provided opposite to the spring chamber 38. The hydraulic control chamber 42 is defined by the pumping unit housing 30' and by a control chamber piston 44 which is a part of the body of the control ring 34. If the hydraulic control chamber 42 is charged with pressurized lubricant, the control ring 34 is pushed into the minimum eccentricity position against the control ring preload spring 40.

The lubricant which is pumped and pressurized in the pumping chamber 26 and in the pumping compartments is directly discharged from the pumping chamber 26 through a pumping chamber outlet 21 to a hydraulic delivery chamber 23 which is defined by the outside surface of the control ring 34 and by the pumping unit housing 30'. The pressure of the lubricant in the hydraulic delivery chamber 23 is the delivery pressure PD of the lubricant pump 10 which is the lubricant pressure at a lubricant delivery port 22. The inlet of the engine's lubricant gallery is fluidically connected to the pump's lubricant delivery port 22 so that the engine's lubricant gallery is provided with lubricant with the delivery pressure PD.

The hydraulic control chamber 42 is charged with the lubricant having the control chamber pressure PC, which can be the gallery pressure PG, the atmospheric pressure PA, or a pressure between the gallery pressure PG and the atmospheric pressure PA. The control chamber pressure PC in the hydraulic control chamber 42 is controlled by a hydraulic control valve 50 which directly regulates the control chamber pressure PC.

The hydraulic control valve 50 is provided with a valve housing which is generally cylindrical inside. A complex valve plunger 60 comprising a cylindrical valve body 64 is provided axially shiftable within the valve housing. The hydraulic control valve 50 is provided with a valve inlet port 54 which is hydraulically directly connected to the pressure gallery pump port 24, with a valve outlet port 56 which is hydraulically directly connected to a pump drain port 20", with a valve control port 58 which is hydraulically directly connected to the hydraulic control chamber 42, and with a hydraulic switch port 52. The hydraulic switch port 52 of the hydraulic control valve 50 is charged via an electrically actuated hydraulic set pressure switch 80 either with the gallery pressure PG of the pressure gallery pump port 24 or with the atmospheric pressure PA of the pump drain port 20".

The valve plunger 60 is mechanically preloaded by a valve preload spring 69 which pushes the valve plunger 60 into the closed valve position in which the hydraulic control chamber 42 is hydraulically connected only to the lubricant tank 14 so that the chamber pressure PC is atmospheric pressure PA.

Figure 2:
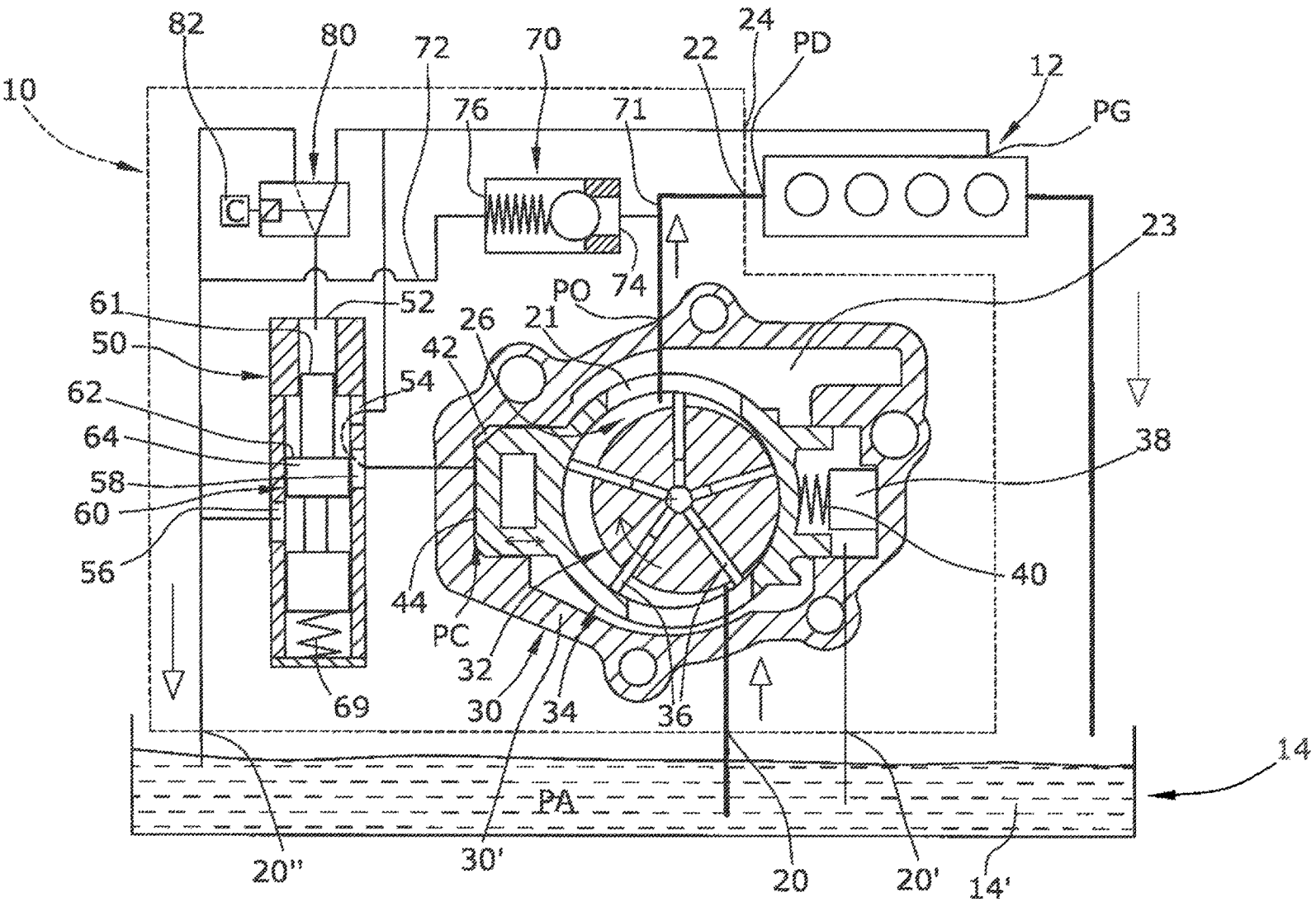
FIG. 2 shows the lubricant pump of FIG. 1 with the pressure control valve in an open status.
Figure 3:
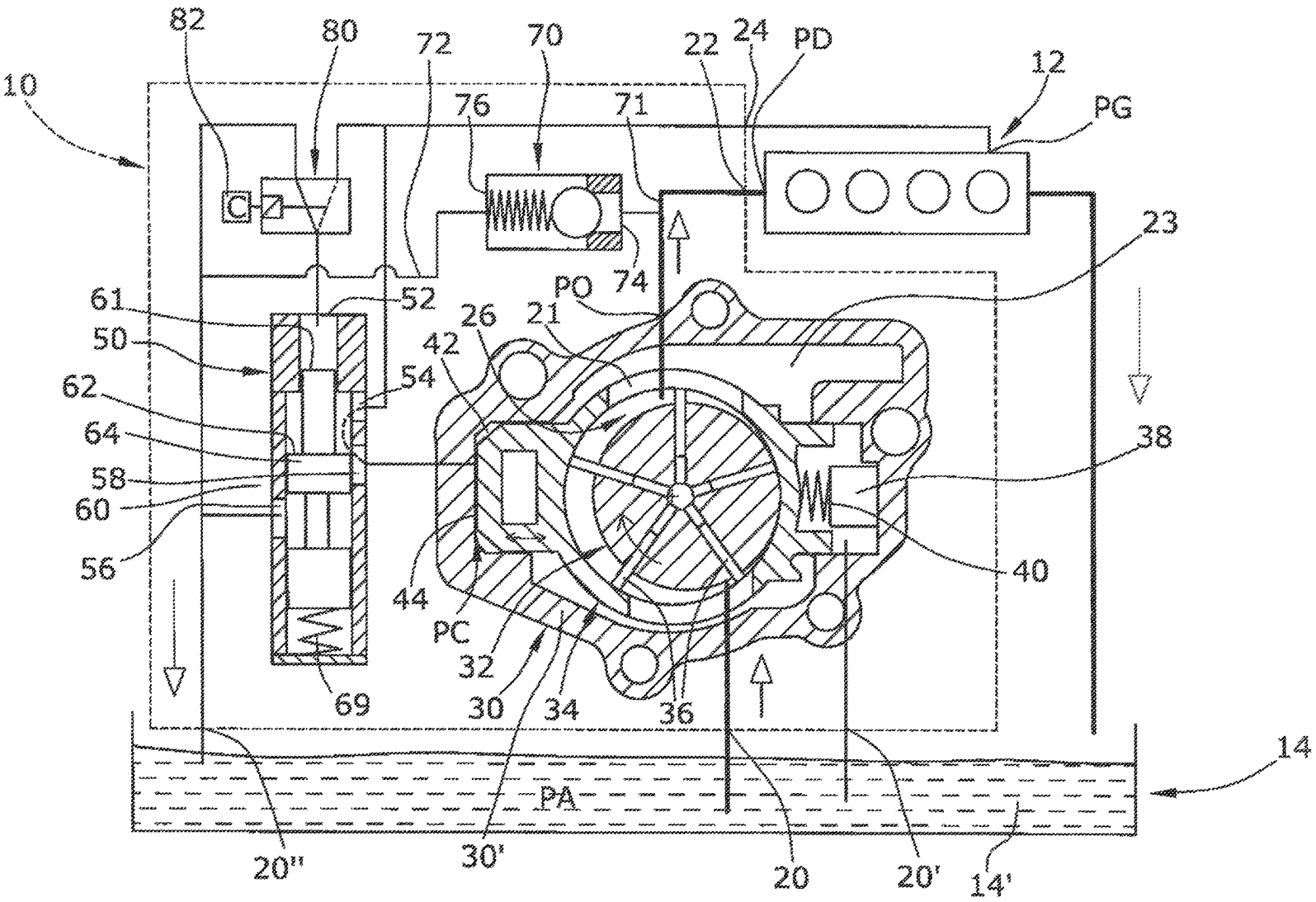
FIG. 3 shows the lubricant pump of FIG. 1 with the two-level hydraulic set pressure switch in a high set-pressure condition.

The electrically actuated hydraulic set pressure switch 80 is electronically controlled by an electronic set pressure control 82 which controls the switching state of the set pressure switch 80. The switch status of set pressure switch 80 depends on, for example, the lubricant temperature and the rotational pump speed. The set pressure switch 80 hydraulically connects the second active plunger surface 61 of the valve plunger 60 to the gallery pressure PG if the set-value of the gallery pressure PG is low, as is shown in FIGS. 1 and 2. If the set value of the gallery pressure PG should be high, the set pressure switch 80 is switched into the high pressure position to connect the second active plunger surface 61 to the atmospheric pressure PA of the lubricant tank 14, as is shown in FIG. 3.

The position of the control ring 34 is the equilibrium position in which the spring force of the control ring preload spring 40 is more or less equal to the hydraulic force generated by the control chamber pressure PC in the hydraulic control chamber 42.

The valve body 64 is, as seen in an axial direction, smaller than the valve control port 58 so that the valve control port 58 is, depending on the position of the valve body 64, fluidically connected only to the pressure gallery pump port 24, as is shown in FIG. 2, or only to the pump drain port 20" of atmospheric pressure PA, as is shown in FIG. 1, or to both the pressure gallery pump port 24 and the pump drain port 20".

The valve plunger 60 is provided with a ring-like first active plunger surface 62 and a circular second active plunger surface 61. The first active plunger surface 62 is directly charged with the gallery pressure PG which is transferred from the engine 12 to the lubricant pump 10 through the pressure gallery pump port 24 and via an internal gallery pressure line.

The second active plunger surface 61 is charged with the gallery pressure PG or with atmospheric pressure PA via a separate hydraulic set pressure switch 80 which is a ⅔ valve. The second active plunger surface 61 is charged with the gallery pressure PG or, depending on the switching status of the set pressure switch 80, with atmospheric pressure PA. The set pressure switch is electrically controlled by an electronic set pressure control 82.

The lubricant pump 10 is also provided with an integrated overpressure valve 70 which is a typical check valve. The overpressure valve inlet 74 is fluidically connected to a pump delivery conduit 71 and is thereby charged with the pump delivery pressure PD. The overpressure valve outlet 76 is fluidically connected to the pump drain port 20" via an overpressure outlet conduit 72.

When the engine 12 is started after having stood still, the liquid lubricant 14' is sucked from the lubricant tank 14 through a pump suction port 20 into the pumping chamber 26 where the lubricant is pumped by the pumping compartments to the hydraulic delivery chamber 23. If the lubricant is cold and has a relatively high viscosity, the lubricant's delivery pressure PD in the hydraulic delivery chamber 23 can be relatively high. The hydraulic control valve 50 cannot properly work as long as no lubricant has arrived in the hydraulic control valve 50. In this constitution of the pump arrangement, the control ring 34 is in a maximum eccentricity position as shown in FIGS. 1 to 3 so that the delivery pressure PD can be higher than a predefined maximum pressure limit PL. If this is the case, the integrated overpressure valve 70 opens the lubricant delivery conduit to atmospheric pressure PA via the pump drain port 20" until the delivery pressure PD is below the predefined maximum pressure limit PL. As soon the hydraulic control valve 50 is working properly, the integrated overpressure valve 70 is normally no longer open. However, the integrated overpressure valve 70 always avoids a delivery pressure PD above the predefined maximum pressure limit PL so that a damage of the slidable rotor vanes 36 is reliably avoided.

Figure 4:
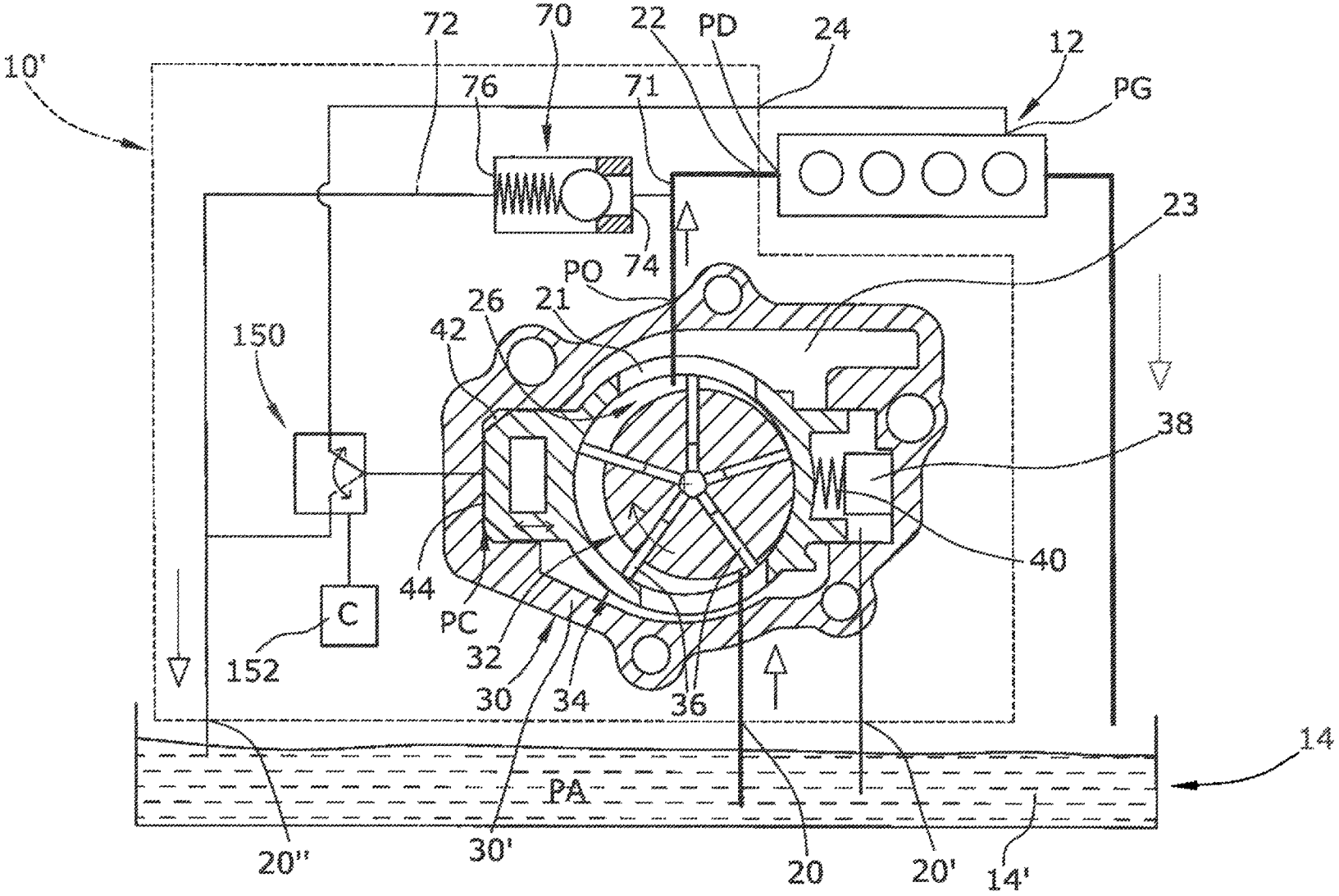
FIG. 4 shows the control circuit with a second embodiment of the variable mechanical lubricant pump with the pump control chamber being charged with the gallery pressure via an electric pressure control valve.

The automotive variable mechanical lubricant pump 10' according to the second embodiment as shown in FIG. 4 is similar to the arrangement of the first embodiment. The hydraulic control chamber 42 is, however, charged via an electric proportional pressure control valve 150. The electric proportional pressure control valve 150 is electrically controlled by a control valve control 152 dependent on several parameters, such as the lubricant gallery pressure, the lubricant temperature etc.

The present invention is not limited to embodiments described herein; reference should be had to the appended claims.

DESCRIPTION OF REFERENCE NUMERALS

10 Variable mechanical lubricant pump
10' Variable mechanical lubricant pump
12 Internal combustion engine
14 Lubricant tank
14' Liquid lubricant
20 Pump suction port
20' Pump drain port
20" Pump drain port
21 Pumping chamber outlet
22 Lubricant Delivery port
23 Hydraulic delivery chamber
24 Pressure gallery pump port
26 Pumping chamber
30 Pumping unit
30' Pumping unit housing
32 Pump rotor
34 Control ring
36 Slidable rotor vanes
38 Spring chamber
40 Control ring preload spring
42 Hydraulic control chamber
44 Control chamber piston
50 Hydraulic control valve
52 Hydraulic switch port
54 Valve inlet port
56 Valve outlet port
58 Valve control port
60 Valve plunger
61 Second active plunger surface
62 First active plunger surface
64 Valve body
69 Valve preload spring
70 Integrated overpressure valve
71 Pump delivery conduit
72 Overpressure outlet conduit
74 Overpressure valve inlet
76 Overpressure valve outlet
80 Set pressure switch
82 Electronic set pressure control
150 Electric proportional pressure control valve
152 Control valve control
PA Atmospheric pressure
PC Control chamber pressure
PD Delivery pressure
PG Gallery pressure
PL Predefined maximum pressure limit

What is claimed is:

1. An automotive variable mechanical lubricant pump for providing a pressurized lubricant for an internal combustion engine, the automotive variable mechanical lubricant pump comprising:

a lubricant delivery port which is fluidically connected to the internal combustion engine;

a control ring which is configured to shift between a maximum eccentricity position and a minimum eccentricity position;

a pump rotor comprising a plurality of slidable vanes which are configured to rotate in the control ring;

a control ring preload spring which is configured to push the control ring into the maximum eccentricity position;

a single hydraulic control chamber which is configured to push the control ring into the minimum eccentricity position;

a pressure galley pump port which is fluidically connected to the internal combustion engine, the pressure galley pump port being configured to charge the single hydraulic control chamber with a galley pressure so as to control a remote galley pressure of the internal combustion engine via a control chamber pressure in the single hydraulic control chamber;

an integrated overpressure valve which is in a fluidic association with the lubricant delivery port, the integrated overpressure valve being configured to open if an applied lubricant pressure exceeds a predefined maximum pressure limit;

an atmospheric pump drain port; and a hydraulic control circuit comprising an electric control valve which is configured to selectivity connect the single hydraulic control chamber to the atmospheric pump drain port or to the pressure galley pump port, wherein, the integrated overpressure valve comprises a downstream end, and the downstream end of the integrated overpressure valve is fluidically directly connected to the atmospheric pump drain port.

2. The automotive variable mechanical lubricant pump as recited in claim 1, further comprising:

a pumping chamber comprising a pumping chamber outlet, wherein, the integrated overpressure valve is configured to be fluidically effective downstream of the pumping chamber outlet of the pumping chamber and upstream of the lubricant delivery port.

3. The automotive variable mechanical lubricant pump as recited in claim 1, wherein the integrated overpressure valve is a check valve.

4. The automotive variable mechanical lubricant pump as recited in claim 1, wherein the electric control valve is a proportional valve.

5. The automotive variable mechanical lubricant pump as recited in claim 1, further comprising:

a hydraulic control circuit comprising a hydraulic control valve which comprises a valve inlet port, the hydraulic control valve being configured to directly regulate a control chamber pressure, wherein, the valve inlet port of the hydraulic control valve is directly charged with the remote galley pressure of the internal combustion engine via the pressure galley pump port.

6. The automotive variable mechanical lubricant pump as recited in claim 5, wherein, the hydraulic control valve further comprises a valve preload spring, a valve control port, and a valve plunger, the valve plunger comprises a first active plunger surface and a valve body which is configured to open and to close the valve control port, the valve preload spring is configured to push the valve body into an open valve position, and the first active plunger surface is charged with the galley pressure of the pressure galley pump port.

7. The automotive variable mechanical lubricant pump as recited in claim 6, further comprising:

an electrically actuated hydraulic set pressure switch, wherein, the valve plunger further comprises a second active plunger surface which is charged with the galley pressure of the pressure galley pump port via the electrically actuated hydraulic set pressure switch.

8. An automotive variable mechanical lubricant pump for providing a pressurized lubricant for an internal combustion engine, the automotive variable mechanical lubricant pump comprising:

a lubricant delivery port which is fluidically connected to the internal combustion engine;

a control ring which is configured to shift between a maximum eccentricity position and a minimum eccentricity position;

a pump rotor comprising a plurality of slidable vanes which are configured to rotate in the control ring;

a control ring preload spring which is configured to push the control ring into the maximum eccentricity position;

a single hydraulic control chamber which is configured to push the control ring into the minimum eccentricity position;

a pressure galley pump port which is fluidically connected to the internal combustion engine, the pressure galley pump port being configured to charge the single hydraulic control chamber with a galley pressure so as to control a remote galley pressure of the internal combustion engine via a control chamber pressure in the single hydraulic control chamber;

an integrated overpressure valve which is in a fluidic association with the lubricant delivery port, the integrated overpressure valve being configured to open if an applied lubricant pressure exceeds a predefined maximum pressure limit; and a hydraulic control circuit comprising a hydraulic control valve which comprises a valve inlet port, the hydraulic control valve being configured to directly regulate a control chamber pressure, wherein, the valve inlet port of the hydraulic control valve is directly charged with the remote galley pressure of the internal combustion engine via the pressure galley pump port, the hydraulic control valve further comprises a valve preload spring, a valve control port, and a valve plunger, the valve plunger comprises a first active plunger surface and a valve body which is configured to open and to close the valve control port, the valve preload spring is configured to push the valve body into an open valve position, and the first active plunger surface is charged with the galley pressure of the pressure galley pump port.

9. The automotive variable mechanical lubricant pump as recited in claim 8, further comprising:

a pumping chamber comprising a pumping chamber outlet, wherein, the integrated overpressure valve is configured to be fluidically effective downstream of the pumping chamber outlet of the pumping chamber and upstream of the lubricant delivery port.

10. The automotive variable mechanical lubricant pump as recited in claim 8, wherein the integrated overpressure valve is a check valve.

11. The automotive variable mechanical lubricant pump as recited in claim 8, further comprising:

an atmospheric pump drain port, wherein, the integrated overpressure valve comprises a downstream end, and the downstream end of the integrated overpressure valve is fluidically directly connected to the atmospheric pump drain port.

12. The automotive variable mechanical lubricant pump as recited in claim 11, further comprising:

a hydraulic control circuit comprising an electric control valve which is configured to selectivity connect the single hydraulic control chamber to the atmospheric pump drain port or to the pressure galley pump port.

13. The automotive variable mechanical lubricant pump as recited in claim 12, wherein the electric control valve is a proportional valve.

14. The automotive variable mechanical lubricant pump as recited in claim 8, further comprising:

an electrically actuated hydraulic set pressure switch, wherein, the valve plunger further comprises a second active plunger surface which is charged with the galley pressure of the pressure galley pump port via the electrically actuated hydraulic set pressure switch.

* * * * *